US012584670B2

(12) United States Patent
Hampel et al.

(10) Patent No.: US 12,584,670 B2
(45) Date of Patent: Mar. 24, 2026

(54) CRYOGENIC REFRIGERATION SYSTEM AND CRYOGENIC PUMP

(71) Applicant: Leybold Dresden GmbH, Dresden (DE)

(72) Inventors: Michael Hampel, Dresden (DE); Sirko Kamusella, Dresden (DE)

(73) Assignee: Leybold Dresden GMBH, Dresden (DE)

( * ) Notice: Subject to any disclaimer, the term of this patent is extended or adjusted under 35 U.S.C. 154(b) by 354 days.

(21) Appl. No.: 18/258,961

(22) PCT Filed: Dec. 22, 2021

(86) PCT No.: PCT/EP2021/087265
§ 371 (c)(1),
(2) Date: Jun. 22, 2023

(87) PCT Pub. No.: WO2022/136534
PCT Pub. Date: Jun. 30, 2022

(65) Prior Publication Data

US 2024/0302088 A1 Sep. 12, 2024

(30) Foreign Application Priority Data

Dec. 24, 2020 (EP) ..... 20217269
Feb. 8, 2021 (GB) ..... 2101714

(51) Int. Cl.
*F25B 9/14* (2006.01)
*F04B 37/08* (2006.01)
(Continued)

(52) U.S. Cl.
CPC ..... *F25B 49/025* (2013.01); *F04B 37/08* (2013.01); *F25B 9/002* (2013.01); *F25B 9/14* (2013.01);
(Continued)

(58) Field of Classification Search
CPC ..... F25B 2600/024; F25B 2600/0253; F25B 49/025; F25B 2500/26
See application file for complete search history.

(56) References Cited

U.S. PATENT DOCUMENTS 4,809,154 A * 2/1989 Newton ..... F25J 1/023 700/28
5,651,667 A * 7/1997 Sand ..... G01L 3/00 318/432
(Continued)

FOREIGN PATENT DOCUMENTS

CN 101413746 A 4/2009
CN 101464073 A 6/2009
(Continued)

OTHER PUBLICATIONS

Machine Translation of CN104094066 (Year: 2014).*
(Continued)

*Primary Examiner* — Filip Zec
(74) *Attorney, Agent, or Firm* — Theodore M. Magee; Westman, Champlin & Koehler, P.A.

(57) ABSTRACT

A cryogenic refrigeration system and method are disclosed. The cryogenic refrigeration system comprises: a refrigerator unit comprising an expansion unit and a variable speed compressor configured to compress refrigerant. The variable speed compressor is configured to receive refrigerant from the refrigerator unit via a lower pressure line and to supply compressed refrigerant to the refrigerator unit via a higher pressure line. There is also control circuitry configured to control the variable speed compressor to maintain a power consumption of the variable speed compressor below a predetermined threshold value, by during cooldown controlling the compressor to initially operate at a reduced frequency and later increasing a frequency of operation of the
(Continued)

variable speed compressor such that the variable speed compressor operates at a higher frequency.

20 Claims, 4 Drawing Sheets

(51) Int. Cl.
*F25B 9/00* (2006.01)
*F25B 41/20* (2021.01)
*F25B 49/02* (2006.01)

(52) U.S. Cl.
CPC ..... *F25B 41/20* (2021.01); *F25B 2500/26* (2013.01); *F25B 2600/024* (2013.01); *F25B 2600/0253* (2013.01); *F25B 2600/0271* (2013.01); *F25B 2600/0272* (2013.01); *F25B 2700/151* (2013.01)

(56) References Cited

U.S. PATENT DOCUMENTS

| | | | | |
|---|---|---|---|---|
| 7,555,911 | B2 * | 7/2009 | Tanaka | F25B 9/14 62/613 |
| 8,448,461 | B2 * | 5/2013 | Longsworth | F25B 9/14 62/401 |
| 8,794,016 | B2 * | 8/2014 | Ogden | F25B 49/005 62/127 |
| 10,288,052 | B2 * | 5/2019 | Dresens | F17D 3/18 |
| 11,022,350 | B2 * | 6/2021 | James | B01D 15/165 |
| 11,262,105 | B2 * | 3/2022 | Maruyama | F25B 49/02 |
| 12,007,165 | B2 * | 6/2024 | Chishti | F25J 1/0252 |
| 12,181,216 | B2 * | 12/2024 | Jin | F25J 1/0022 |
| 2010/0326133 | A1 * | 12/2010 | Beeby | F25J 1/0052 62/614 |
| 2012/0036888 | A1 * | 2/2012 | Vandor | F25J 1/0283 220/560.04 |
| 2012/0079850 | A1 * | 4/2012 | Sicinski | F25J 1/0022 62/611 |
| 2014/0260339 | A1 * | 9/2014 | Matsui | F04B 37/085 62/55.5 |
| 2015/0135735 | A1 | 5/2015 | Matsui | |
| 2015/0267942 | A1 * | 9/2015 | Nakashima | F25B 9/14 62/6 |
| 2016/0238296 | A1 * | 8/2016 | Saint Pierre | F25B 49/027 |
| 2017/0292783 | A1 * | 10/2017 | Chen | F25J 1/0072 |
| 2018/0017320 | A1 * | 1/2018 | Bahari | F25J 1/0055 |
| 2018/0202689 | A1 * | 7/2018 | Ieda | F25B 1/10 |
| 2022/0074654 | A1 * | 3/2022 | Jin | F25J 1/0022 |
| 2023/0228472 | A1 * | 7/2023 | Morie | F25B 9/145 62/6 |
| 2024/0302088 | A1 * | 9/2024 | Hampel | F25B 9/14 |

FOREIGN PATENT DOCUMENTS

| | | | |
|---|---|---|---|
| CN | 103917833 | A | 7/2014 |
| JP | S6346351 | A | 2/1988 |
| JP | H05113259 | A | 5/1993 |
| JP | H09303897 | A | 11/1997 |
| JP | 2002106991 | A | 4/2022 |
| KR | 102033991 | B1 | 11/2019 |
| WO | 2012122144 | A1 | 9/2012 |

OTHER PUBLICATIONS

Machine Translation of JP 2002106991 (Year: 2002).*
Japanese Notification of Reason for Rejection dated Jun. 14, 2024 for corresponding Japanese application Serial No. 2023-563153, 10 pages.
PCT Notification of Transmittal of the International Search Report and the Written Opinion of the International Searching Authority, or the Declaration, Search Report and Written Opinion dated Apr. 5, 2022 for corresponding PCT application Serial No. PCT/EP2021/087265, 9 pages.
British Search Report dated Oct. 4, 2021 for corresponding British application Serial No. GB2101714.0, 1 page.
British Written opinion dated Oct. 4, 2021 for corresponding British application Serial No. GB2101714.0, 4 page.
Chinese First Office Action dated May 12, 2025 and Search Report dated Apr. 17, 2025 for corresponding Chinese application Serial No. 202180087628.8, 19 pages.

* cited by examiner

CRYOGENIC REFRIGERATION SYSTEM AND CRYOGENIC PUMP

CROSS-REFERENCE OF RELATED APPLICATION

This application is a Section 371 National Stage Application of International Application No. PCT/EP2021/087265, filed Dec. 22, 2021, which is incorporated by reference in its entirety and published as WO 2022/136534 A1 on Jun. 30, 2022, the content of which is hereby incorporated by reference in its entirety and which claims priority of European Application No. 20217269.8, filed Dec. 24, 2020 and British Application No. GB2101714.0, filed Feb. 8, 2021.

FIELD

The field of the invention relates to cryogenic refrigeration systems, cryogenic pumps and methods of refrigerating.

BACKGROUND

Cryogenic refrigeration systems are known. Such systems use a refrigeration process such as the Gifford-McMahon process and generally comprise an expansion type refrigerator unit housing a thermal accumulation material and an expansion chamber. A compressor compresses a refrigerant gas and supplies the compressed refrigerant to the refrigerator unit where it is cooled by the thermal accumulation material and then expanded. The reduced pressure refrigerant gas is returned to the compressor, thereby forming a refrigerating cycle. An extremely low temperature may be obtained by repeating this refrigerating cycle. For low cryogenic refrigeration helium may be the preferred refrigerant.

The effectiveness of the refrigeration process is influenced by the pressure difference between the higher pressure and lower pressure refrigerant and by the mass flow rate of the refrigerant. However, these factors are themselves limited by the compressor's capabilities.

It would be desirable to provide an improved refrigeration system.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a cryogenic refrigeration system comprising: a refrigerator unit comprising an expansion unit; a variable speed compressor configured to compress refrigerant, said variable speed compressor being configured to receive refrigerant from said refrigerator unit via a lower pressure line and to supply compressed refrigerant to said refrigerator unit via a higher pressure line; and control circuitry configured to control said variable speed compressor to maintain a power consumption of said variable speed compressor below a predetermined threshold value, by during cooldown controlling said compressor to initially operate at a reduced frequency and later increasing a frequency of operation of said variable speed compressor such that said variable speed compressor operates at a higher frequency.

The effectiveness of a refrigeration process is increased with an increased pressure difference between the higher pressure and lower pressure lines and with an increased mass flow rate of refrigerant. Increases in these factors can be achieved by increasing the filling pressure of the system as well as by increasing the compressor speed. However, increasing the compressor speed and increasing the pressure of the refrigerant both increase the power consumption of the compressor and the power consumption of a compressor is generally limited to avoid it overheating and failing.

The inventors of the present invention recognised that the power consumption of the compressor varies during operation and in particular, may be at its highest during cooldown and be lower during steady state operation. In particular, as the temperature decreases there may be some accumulation of the refrigerant in the refrigeration unit and the pressure of the refrigerant will fall. This fall in pressure allows the compressor to operate at a higher frequency without requiring additional power. Thus, they realised that were control circuitry to be provided to control the compressor to operate at a lower speed initially during cooldown and thereby limit the power supplied to the compressor, then the frequency of operation could be increased later as the pressure of refrigerant falls. This would allow the compressor to be configured to operate at higher frequencies during steady state operation while being protected from overheating during cooldown and an improved performance could be provided.

In some embodiments, said cryogenic refrigeration system is provided with additional refrigerant by at least one of: increasing an initial filling pressure such that operation of said variable speed compressor at full speed during cool down of said refrigerator unit would result in the variable speed compressor consuming power above said predetermined threshold value; or by providing a buffer volume of refrigerant in fluid communication with a low pressure line supplying lower pressure refrigerant from said refrigeration unit to said compressor.

The refrigeration or cooling power of a refrigeration process such as the Gifford-McMahon process is driven by the pressure difference of the working fluid or refrigerant. According to the thermodynamic principle of expansion of a gas from a high pressure level (supply pressure) to a lower pressure level (return pressure), the cooling power of the system is higher the higher the pressure difference between these two pressures. Furthermore, the higher the mass flow rate of refrigerant through the system the higher the cooling power provided.

This pressure increase provided by the compressor should therefore be as high as possible. The capacity of the compressor is limited by its compression ratio and the maximum allowed power consumption, which in many cases is related to the maximum allowed current in the motor windings of the motor driving the compressor. The compression ratio depends firstly on the volume ratio between the high and low pressure volume of the system and secondly from the filling pressure of the system and thirdly of course from the equilibrium between refrigerant demand of the refrigeration unit and the pump capacity of the compressor.

Improved cooling power of the refrigeration unit may be provided by increasing the filling pressure of the refrigerant. By increasing the filling pressure both the high and low pressures will increase and therefore the recirculated mass flow of the refrigerant rises. However, this will increase the demand for electrical power needed for the compression of the refrigerant as well. Providing control circuitry to control the speed of operation of the compressor and to limit the power consumed allows the system to be designed with additional refrigerant.

In summary, an additional amount of refrigerant may be provided by increasing the initial filling pressure, in effect over filling the refrigeration system and/or by providing an additional buffer volume in fluid communication with the lower pressure line and thereby changing the volume ratio between the high and low pressure volumes. The initial filling pressure of a system is generally set so that when the compressor operates at full speed it will not consume power above its specified power consumption value and will therefore not overheat or cut out. Having a control system that sets the maximum power that can be consumed by the compressor allows the initial filling pressure of the refrigerant to be increased without the risk of the compressor overheating and cutting out. In some cases however the compressor may not operate effectively at a high pressure and in this case, the additional refrigerant may be supplied in the form of an additional buffer volume and thereby additional refrigerant is present without increasing the initial filling pressure.

It should be noted that the additional filling pressure is the pressure of the refrigerant in the system when the system is not operational. This initial filling pressure may be specified for a particular refrigeration system. The full speed of operation of the compressor may be the maximum operational speed or frequency of the compressor in the steady cooled stage of operation where the low temperature is maintained and the refrigeration system is not in power save mode.

In some embodiments, said control circuitry is further configured to control said variable speed compressor to maintain the pressure of said higher and lower pressure lines within predetermined limit values.

Compressors may operate effectively within certain pressure limits, scroll compressors for example may have a performance map which defines limit values of high and low pressure, operation within these limits being acceptable. These limits are dependent upon the mechanics of the pump, namely the housing strength and upon thermodynamic (thermal balance) limitations of the scroll unit. In some embodiments the control circuitry that is configured to control the speed of the compressor in order to limit the power consumption can also be used to control the speed to maintain the operation of the compressor within these predefined pressure limits.

In some embodiments said refrigeration system further comprises at least one pressure sensor to sense the pressure difference between the higher and lower pressure lines.

The system may comprise a higher pressure line sensor and a lower pressure line sensor or it may comprise a differential pressure sensor for measuring the difference in pressure between the two pressure lines. Signals from these pressure sensors are sent to the control circuitry.

In some embodiments, the cryogenic refrigeration system further comprises an inlet valve on said higher pressure line; and said control circuitry is further configured to control said inlet valve to maintain the pressure of said higher and lower pressure lines within predetermined limit values.

In some embodiments, the control circuitry is configured to maintain a pressure differential between said higher pressure line and said lower pressure line within predetermined limit values.

In some embodiments, the control circuitry may control both the speed of the compressor and the operation of the inlet valve in order to keep the higher and lower pressure values within predetermined limits.

In order to control operations during steady state operation in addition to maintaining the power below the predetermined threshold value the control circuitry may also control an inlet valve to the refrigeration unit so as to maintain a desired pressure difference between the higher pressure and lower pressure lines and ensure an effective cooling.

In some embodiments, said control circuitry is configured to increase said frequency of operation of said variable speed compressor in response to a detected fall in power consumption of said variable speed compressor.

During cooldown there are three effects that influence the refrigerant pressure in the system. There is a pressure increase due to the compressor warming up to its operation temperature generally about 60° C. There is also a pressure increase due to the warming of refrigerant in the low pressure volume caused by a thermal load of the refrigerator unit which may increase the helium temperature from 20 to 50° C. However, there is also a pressure decrease in the system caused by the refrigerant accumulation in the cold end of the refrigeration unit.

This third effect is greater than the first two effects and thus, as the system cools down the refrigerant pressure within the system decreases and this becomes particularly pronounced at lower temperatures. Thus, the compressor during cooldown will generally see a fall in pressure and the power consumption of compressor will also fall. In some cases, the control circuitry increases the frequency of operation of the compressor in response to detecting this fall in power to maintain the power consumption of the compressor close to the threshold value, in some cases within 10% of it.

In some embodiments, said maximum frequency of operation during steady state operation is between 50 and 70 Hz and said initial frequency of operation during cooldown is lower between 30 and 50 Hz.

The initial frequency of operation may be substantially less than the steady state frequency of operation, in some cases it may be 35 hz increasing until it reaches the maximum frequency of operation which in some embodiments is 60 hz. This is a frequency of operation which the variable speed compressor operates at in the steady state. In some embodiments, the steady state operation may be slightly lower than the maximum operating frequency.

In some embodiments the refrigerant comprises helium.

In some embodiments, said refrigeration unit is configured to cool to 80K, preferably to 50K, more preferably to below 10K, more preferably to 4K.

The refrigeration unit may be a low temperature refrigeration unit able to cool to 80K, or in some embodiments it may be a particularly low temperature refrigeration unit in some embodiments cooling down as low as 4 k. The effects of the accumulation of the refrigerant in the refrigeration unit and the corresponding lowering of pressure within the refrigeration system is particularly pronounced where the refrigeration unit operates at the very low temperatures. Thus, embodiments are particularly effective for such refrigeration systems.

In some embodiments, an initial pressure of said refrigerant is 5%, preferably 10% higher than specified for the refrigeration unit where there is no power control of the variable speed compressor during cooldown.

Where there is no power control of the compressor during cooldown, then generally it will be driven at a constant speed and the speed/pressure of refrigerant will be set so that the compressor does not overheat during cooldown where there is peak power consumption. Where there is power control during cooldown, then the refrigerant pressure may be increased as the power consumption during cooldown is controlled and is no longer the limiting factor.

In some embodiments, said refrigeration system further comprises said buffer volume of refrigerant, said buffer volume containing more than 20% of a total amount of refrigerant within said refrigeration system, preferably more than 50%, in some cases more than 90%.

The refrigeration system may be provided with additional refrigerant in some cases an additional 20% by volume or mass of refrigerant and in other case more than an additional 50 or 90% of refrigerant. The refrigeration system may be configured to operate with a certain amount of refrigerant such that when operating at maximum operational speed of the variable speed compressor from start up the power threshold consumed by the compressor is not exceeded. This is the standard amount of refrigerant for a refrigeration system and embodiments which provide power control of the compressor may provide an additional amount of refrigerant by either increasing the initial filling pressure and/or supplying it in a buffer volume associated with a lower pressure line, the buffer volume altering the volume ratio between the high and low pressure volumes.

A refrigeration system may be specified to operate with refrigerant at an initial filling pressure of between 13-17 bars. Where it is specified for the lower end of this range then the pressure may be increased by over filing with refrigerant and increasing the filling pressure in the system. This is acceptable with refrigeration systems according to embodiments as the compressor power supply is controlled to be maintained below a threshold value. Where the system is supplied with refrigerant at the higher end of this range then the compressor may not be configured to operate at pressures above that specified and in such a case, additional refrigerant may be supplied using a buffer volume in the low pressure line that alters the volume ratio between the high and low pressure volumes. In some cases, there may be a combination of increasing the pressure of the refrigerant and adding a buffer volume.

In some embodiments, said control circuitry is further configured to control said variable speed compressor in a power save mode to maintain a power consumption of said variable speed compressor below a predetermined reduced threshold value.

The control circuitry may also be configured to operate a power save mode where in response to determining that there is a reduced load on the refrigeration system during steady state operation it sets a reduced threshold value for the compressor power. The same control circuitry as is used for the cool down can then control the power consumption in this reduced load, power save mode.

A second aspect provides a cryopump comprising a cryogenic refrigeration system according to the first aspect.

A third aspect provides a method of operating a cryogenic refrigeration system comprising a refrigerator unit comprising an expansion unit and a variable speed compressor configured to compress a refrigerant, such that a higher pressure refrigerant is supplied to said refrigerator unit and a lower pressure refrigerant is received from said refrigerator unit, said method comprising during an initial cooldown of said refrigeration unit operating said compressor at an initial lower frequency to maintain a power consumed by said variable speed compressor below a predetermined threshold value; and later increasing a frequency of operation of said compressor to a full speed of operation.

In some embodiments, the method further comprises an initial step of providing said refrigeration system with an increased quantity of refrigerant by at least one of: increasing a filling pressure of refrigerant within said system such that operation of said variable speed compressor during cool down at a maximum frequency of operation would exceed said predetermined threshold value for power consumption; or providing a buffer volume of additional refrigerant in fluid communication with said lower pressure line.

It should be noted that the efficiency of the system is generally improved for lower speeds of the compressor, so overfilling the refrigeration system with refrigerant allows it to operate efficiently at lower speeds during cooldown. When the pressure of the refrigerant falls due to accumulation of refrigerant in the refrigeration unit or coldhead at lower temperatures then the speed of the compressor can be increased and cooling efficiency can be maintained.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1:
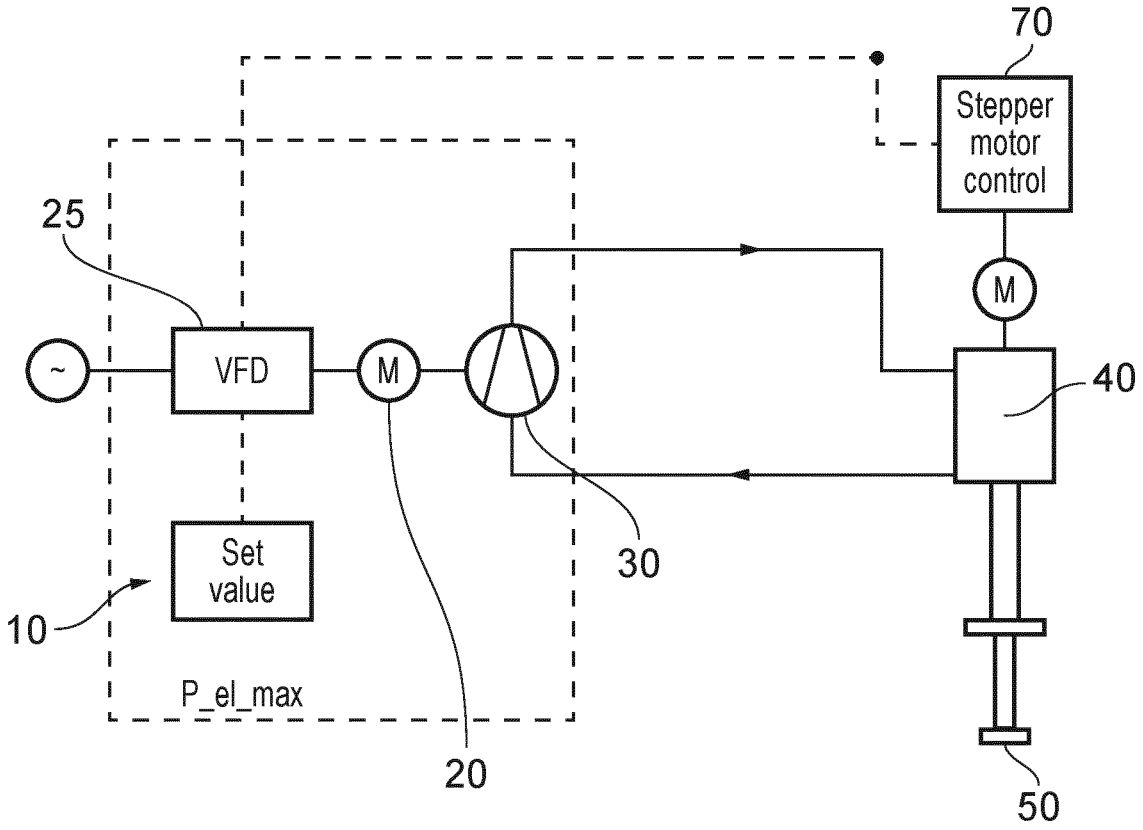
FIG. 1 shows a cryogenic refrigeration system according to a first embodiment.

Before discussing the embodiments in any more detail, first an overview will be provided.

Embodiments provide a cryogenic cooling device. Embodiments may be used in cryogenic cooling systems, which may be for a superconducting magnet/coil. They may be used in cryogenic condenser systems and in cryogenic pump systems for resublimation, desublimation, solidification or deposition of gases.

Such cryogenic devices operate initially in a cooldown mode and then in a steady state refrigeration mode. During the cooldown process when the refrigeration unit cools, the refrigerant inside the cooler part of the refrigeration unit, such as within a coldhead piston system accumulates significantly. This will result in a decrease of the high and low pressures in the refrigeration system. This decrease in refrigerant leads to a decrease in the electric power consumption of the compressor. Therefore without adjustment in the steady state at the cooled temperatures the compressor will run with reduced amounts of refrigerant.

However, if the amount of refrigerant in the system is increased to compensate for that accumulated in the refrigerant unit in the steady state, there is a danger during initial cooldown of the compressor becoming overloaded. There is a relatively short period during cooldown where the pressures within the system are at their highest and there is a danger of thermal overload of the compressor during this period.

Embodiments address these competing problems and seek to achieve an improved cooling power in the steady state operation as well as improving the refrigerator cooldown process by the use of a control mode controlling the winding current and electric power of the compressor motor. A threshold power value is set and the motor is controlled to turn at a frequency such that the power consumed is below this threshold power.

This control mechanism can support both initial cooldown and also the start up of the system in case of restart during warm up of compressor or mismatch in cooldown of coldhead or restart of warm system or restart in non-steady state conditions.

Having this control mechanism allows additional refrigerant to be added to the system. This may be done by increasing the filling pressure of the system. The pressure of the refrigerant in the refrigeration unit or coldhead connected to the compressor is fixed by the initial filling. During startup of the cryosystem (switch on of coldhead refrigerant valve drive followed by switch on of the compressor) the coldhead is cooled down typically within 20 to 60 minutes. This cooldown process is affected by three factors that influence the refrigerant pressure of the system.

1) Pressure increase by heat up of compressor volumes consisting of Scroll volume and oil pre-separator volume to operation temperature 60° C.
2) Pressure increase by heat up of refrigerant low pressure volume flow caused by thermal load of the coldhead (increase of refrigerant temperature from 20 to 50° C.)
3) Pressure decrease in system caused by refrigerant accumulation in cold end of coldhead.

Effect No. 3 is significantly greater than effects 1 and 2 causing a lower "equivalent" refrigerant system pressure in the whole system especially for low temperature applications. Consequently, both the high and the low pressure decrease which limits the coldhead performance and furthermore, the compressor cannot achieve its full refrigerant mass flow potential because suction pressure is too low.

In order to boost the recirculating refrigerant mass flow and to regulate the system to increase the differential pressure the speed of the compressor can be increased (e.g. from 50 to 70 Hz). It was determined that the efficiency of the compressor is lower the higher the speed. The reason for this is the rising dissipation of energy by increasing compressor speed which will increase gas velocities in the piping and compressor housing leading to pressure loss of gas and cause low suction pressures. Therefore it may not be optimal to run the compressor at its highest possible speed targeting a given differential pressure. Instead, increasing the amount of refrigerant perhaps by enhancing the filling pressure may provide both improved performance and an increase in efficiency.

For conventional systems such overfilling is not possible because the required larger motor currents (to pump the denser refrigerant) of the compressor which may be a scroll pump, leads to an overheating of the windings (which may lead to cut out due to a motor protection switch).

The problem of thermal switch off of the compressor has been addressed in embodiments by a power control for the compressor which may be adjusted to the max allowed current in motor windings which will not result in too high winding temperatures. The power control will affect the frequency of the compressor drive (motor). That means a substantially constant level of electric power consumption will result in a compressor motor speed which is below the rated speed of the compressor motor initially, but this effect is compensated for in some embodiments by increasing the refrigerant filling pressure. This feature allows a defined refrigerant pressure overfilling of the system without the danger of thermal switch off nor overload. With such a power control the cooldown process will start with moderate or low compressor speed supplying the necessary pressure differential as well as the required refrigerant flow for the operation of the coldhead.

Additionally and/or alternatively the effect may be compensated for by providing a buffer volume of refrigerant associated with the low pressure line. In this regard, filling pressure and mass flow rate may not only be influenced by the actual filling pressure of the stopped system, but may be influenced in the same way by creating a permanent low pressure volume excess, which transfers a refrigerant mass to the smaller high pressure volume thus increasing the total system pressure in running operation. This option may be necessary to work around low pressure strength limitation of compressor components.

In summary a reduced pressure differential between high (supply) and low (return) pressure is compensated for in the performance of the coldhead if additional refrigerant such as helium is used, either by providing a higher helium pressure when the system is initially filled and/or by providing a buffer volume of helium attached to the low pressure line, both of which leads to increased helium mass flow.

Figure one shows a cryogenic system according to an embodiment. The cryogenic refrigeration system comprises control circuitry 10 configured to control a motor 20 driving a compressor 30 compressing the refrigerant in the refrigeration system. The control circuitry 10 also controls motor 70 which drives an inlet valve, not shown, controlling the supply of higher pressure refrigerant to the refrigeration unit or coldhead 40. In this embodiment, there is a temperature sensor 60 associated with the colder portion of coldhead 50.

The control circuitry 10 comprises a data store that stores a threshold value for setting a maximum value for the power and/or electric current supplied to the compressor.

In this embodiment the refrigeration unit 40 comprises a Gifford McMahon refrigerator unit (this Gifford McMahon piston system is hereinafter designated as the "coldhead") and the compressor 30 supplies pressurized helium as the cryogenic agent or refrigerant. The system is a hermetically sealed system with a closed refrigerant cycle. In order to improve the performance of the cryogenic system the control system 10 is provided, and this allows the measurement and regulation of variable frequency drive output electric current and/or electric power supplied to the compressor motor 20.

Maintaining the power consumption of the compressor 30 below a threshold value allows the refrigeration system to be configured with a higher initial filling pressure of refrigerant as this is no longer limited by the power consumed by the compressor running at maximum speed during the cooldown process.

In this embodiment the compressor motor 20 is directly connected to a variable frequency drive (VFD) 25 supplying power to the compressor and controlled by the control circuitry 10. This electrical current and/or electrical power control will affect the output frequency of the VFD and thus, the speed of rotation of the compressor motor. This control circuitry 10 seeks to adjust the compressor revolution speed to close to the maximum allowed electrical load of the windings of the motor 20 without danger of thermal switch off.

The system operates as follows:

Start up procedure:

1) Switch on of coldhead 40 and compressor 30
2) VFD 25 ramps up the output frequency of the power suppled to the compressor motor 20 until the threshold value of the winding current and/or power is reached, in this way the control circuitry 10 limits the VFD 25 output frequency.
3) During heat up of compressor-coldhead system the most critical load case is passed with limited frequency by control of VFD 25 which will limit the revolution speed of the compressor 30 and cause lower winding current and/or power.
4) Progress in cooldown of the coldhead 40 will result in more and more helium accumulating in the coldhead 40. This will result in decreasing system pressures. VFD 25 will provide controlled ramp up to the output frequency of the current and/or power supplied to the motor.
5) Steady state operation is achieved. Current and/or power control will advise VFD to release max possible frequency of VFD to motor 20. At this point the control of the system may pass to control of the inlet valve by stepper motor 70, this may be controlled to provide a desired pressure differential between supply and return pressure lines.

Surprisingly it was detected, that it is not necessary to run the compressor with the highest possible revolution speed in order to achieve maximum cooling power on the coldhead in the steady state. Rather increased cooling power in steady state operation may be measured by using a system configuration where the VFD output frequencies are restricted compared to grid frequency while maintaining full winding current/power. There was a preferred operating point found between the mass flow of recirculating helium and the pressure difference between supply and return pressure in the system. In this regard, the power consumed depends on the frequency/speed of the compressor as well as the suction and high pressure. By combining control based on the pressures in the system and the speed of the compressor, then a preferred operating point may be found. The reason for this may be the rising dissipation of energy in the system at higher compressor speeds which will immediately cause performance loss. Therefore it may not be desirable to run the compressor at the highest possible speed allowed for a particular threshold power and a maximum possible differential pressure in the system and with appropriate measurement and control a preferred operating point with a lower frequency may be found.

In some embodiments, this current/power control system 10 can also be used for limiting the energy demand of the cryogenic system in the steady state under partial load conditions. In this case an additional set point or threshold value corresponding to lower winding current/electric power may be used. In this way an energy save mode can be supported using the same control circuitry.

Figure 2:
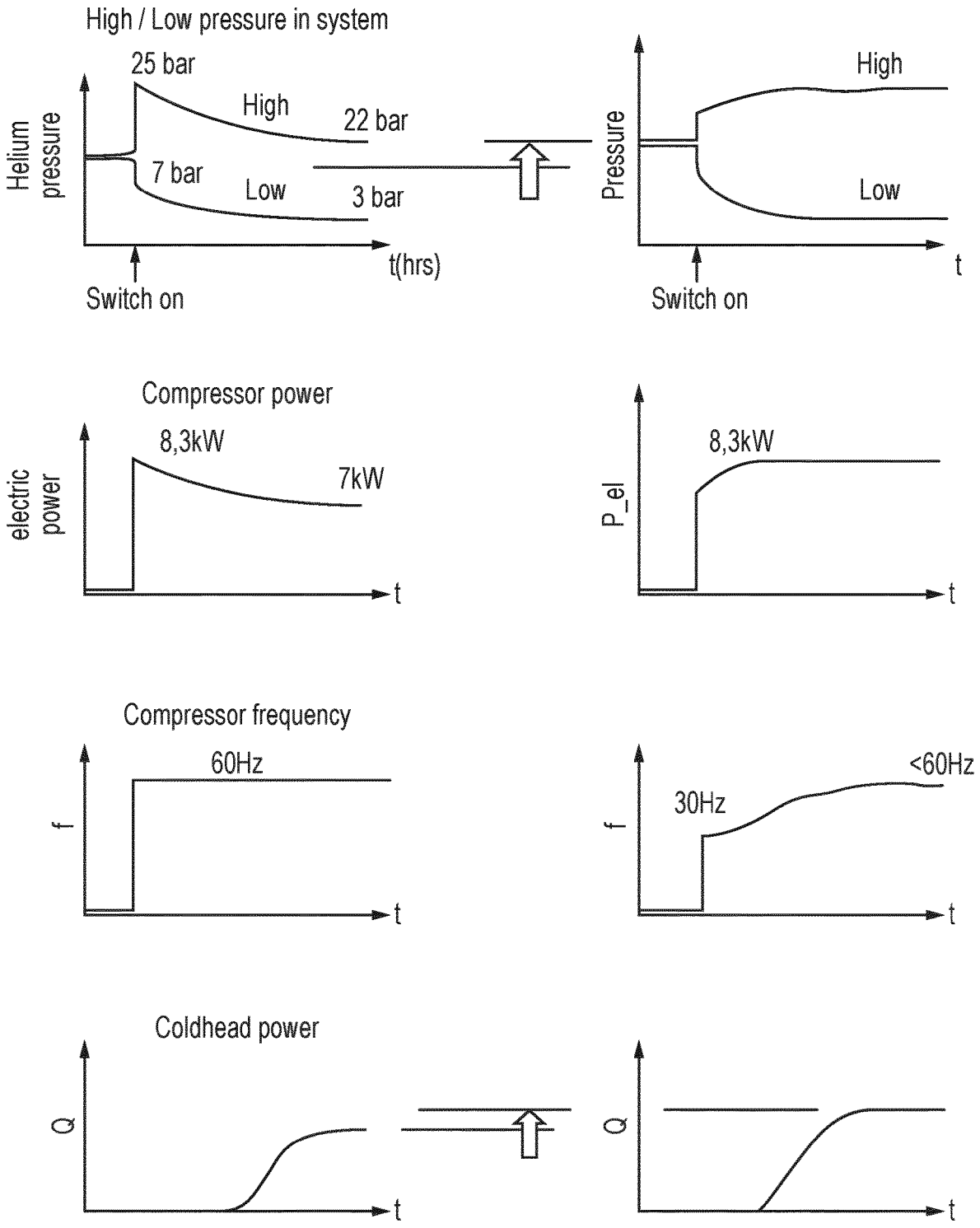
FIG. 2 shows the difference between a conventional cryogenic refrigeration system and a cryogenic refrigeration system according to an embodiment.

FIG. 2 shows the operation of embodiments compared to conventional refrigeration systems. The left-hand side graphs shows the operation of a conventional system whereas the right-hand side graphs shows the operation of a refrigeration system according to an embodiment.

The upper left-hand graph shows how the pressure in a conventional system is lower initially prior to switch on, and then following switch on both the high pressure line and the low pressure line have pressures which gradually decrease as the temperature drops and refrigerant accumulates in the coldest part of the system. With the system according to an embodiment, the initial refrigerant pressure is higher as the system is "over-filled". The compressor speed is limited at switch on so the high and low pressure lines take time to reach a steady state value. Once attained these pressures are maintained and the higher pressure is higher than the higher pressure in the conventional system due to the initial over-filling.

In the second set of graphs compressor power is shown to decrease over time in a conventional refrigeration system after start up as the pressure in the system reduces due to the accumulation of the refrigerant in the coldest part of the coldhead. The right-hand graph shows how the power supplied to the compressor is reduced initially during cooldown and this corresponds to a lower compressor speed. The power gradually increases to a maximum power which can be maintained once the system reaches the steady state. This maximum power that the compressor can safely cope with is in both embodiments 8.3 KW, however, by control of the compressor during cooldown in an embodiment, this higher power can be applied to the compressor in the steady state without overloading the compressor during cooldown.

The third pair of graphs show how the frequency of operation of the compressor varies for a conventional refrigeration system and that of an embodiment. The refrigeration system of an embodiment has a reduced frequency of operation of the compressor initially which increases to the full maximum speed or close to the full maximum speed once cooldown has finished. The compressor of the prior art has the single speed of operation.

The final two graphs show how an embodiment provides an improved coldhead power due to the increased mass flow rate of the refrigerant that embodiments can provide either by overfilling the system or providing an additional volume.

Figure 3:
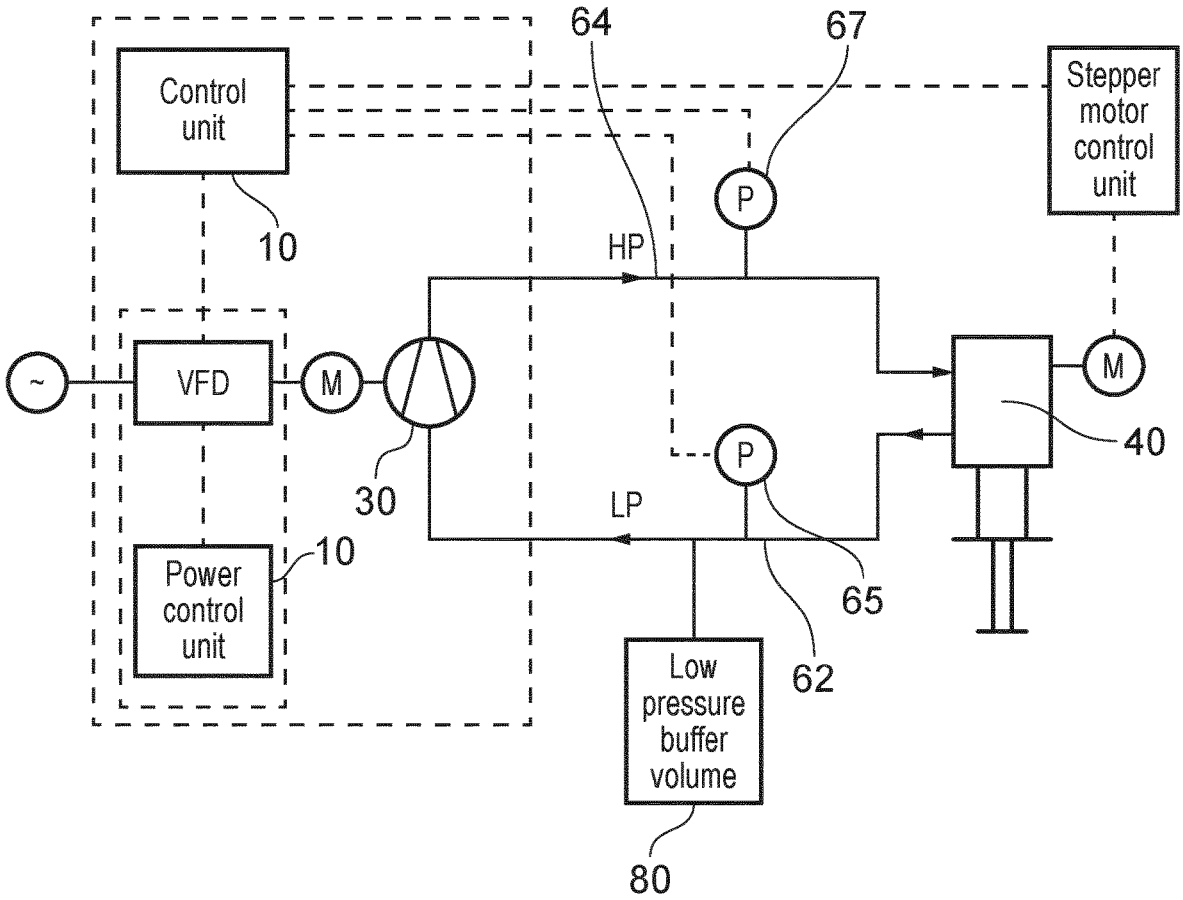
FIG. 3 shows a cryogenic refrigeration system according to a further embodiment.

FIG. 3 shows an alternative embodiment of a refrigeration system which has a low pressure buffer volume 80 connected to low pressure line 62 which line returns refrigerant from the refrigeration unit 40 to the compressor 30. There is a pressure sensor 65 for sensing the pressure of the low pressure line 62 and an additional pressure sensor 67 for sensing the pressure of the high pressure line 64. In some embodiments, a differential pressure sensor may be used instead of high and low pressure sensors.

During operation the control circuitry 10 controls both the compressor speed by controlling the frequency of rotation of the motor driving the compressor in dependence upon a power threshold, and the frequency of rotation of the inlet value for supplying high pressure refrigerant from the higher pressure refrigerant line 64 to the refrigeration unit or coldhead 40.

Operation of the refrigeration system starts with the compressor driven at an initially lower frequency while the pressure of the refrigerant is higher, the frequency of operation being set by the threshold power limit of the compressor motor controlled by control circuitry 10. As the refrigerant pressure falls due to accumulation of the refrigerant in the colder part of the refrigeration unit 40 the power used by the compressor falls too and the control circuitry detects this and increases the frequency and the revolution speed which leads to increased motor winding current and power consumption such that power consumption is kept close to the threshold level in some embodiments within 2% of this value, in others within 5% and in still others within 10% of the threshold power level. In this way, as the pressure of the refrigerant falls the speed of the motor increases while the power consumed by the motor is maintained below but close to the threshold value. Once the system has reached the steady state the compressor is operating at or close to its maximum frequency, the refrigeration system may be controlled by control circuitry 10 controlling the inlet valve for the coldhead 40. Controlling the inlet valve controls the differential pressure of the refrigeration system which again affects the cooling of the refrigeration system. In this regard the compressor may operate effectively within certain high and low pressure limits, which for a scroll compressor may be defined in a scroll performance map which sets limit values for the high and low pressure lines that the compressor can operate effectively within. In some embodiments, control unit 10 may be used to control the speed of operation of the compressor not only to ensure that maximum power consumption is not exceeded but also to ensure that the high and low pressure limits of the scroll performance map are not breeched. Thus, control unit 10 receives signals from the pressure sensors 65 and 67 and in response to either of these indicating that the pressure in the high and/or low pressure lines are moving towards a limit value, the control unit may amend the speed of operation of the compressor to bring the pressures away from these limit values. In some embodiments the control unit 10 may control one or both of the inlet valve and the speed of the compressor to maintain the operation of the compressor within the desired pressure limits.

In this embodiment, there is a low pressure buffer volume 80 which allows additional refrigerant to be supplied to the system without increasing the pressure within the system to beyond that that the scroll compressor 30 can operate effectively at. In this way this embodiment adjusts the volume ratio between high and low pressure and increases the amount of refrigerant in the system without increasing the filling pressure. This is an alternative option to increasing the filling pressure of the refrigerant (although it may be used in conjunction with this option).

Both options for increasing the refrigerant amount, that is increasing the filling pressure and supplying an additional buffer volume, may be used to adjust the operating conditions of the refrigeration unit to increase the cooling power and/or the efficiency of the system. The technical limit for increasing the cooling power is the electrical power consumption of the compressor which will lead to high currents in the windings of the compressor motor. Where these become too high a thermal protection switch (circuit breaker) will operate and shut down the compressor motor. This should be avoided for safe and stable operation of the system.

Figure 4:
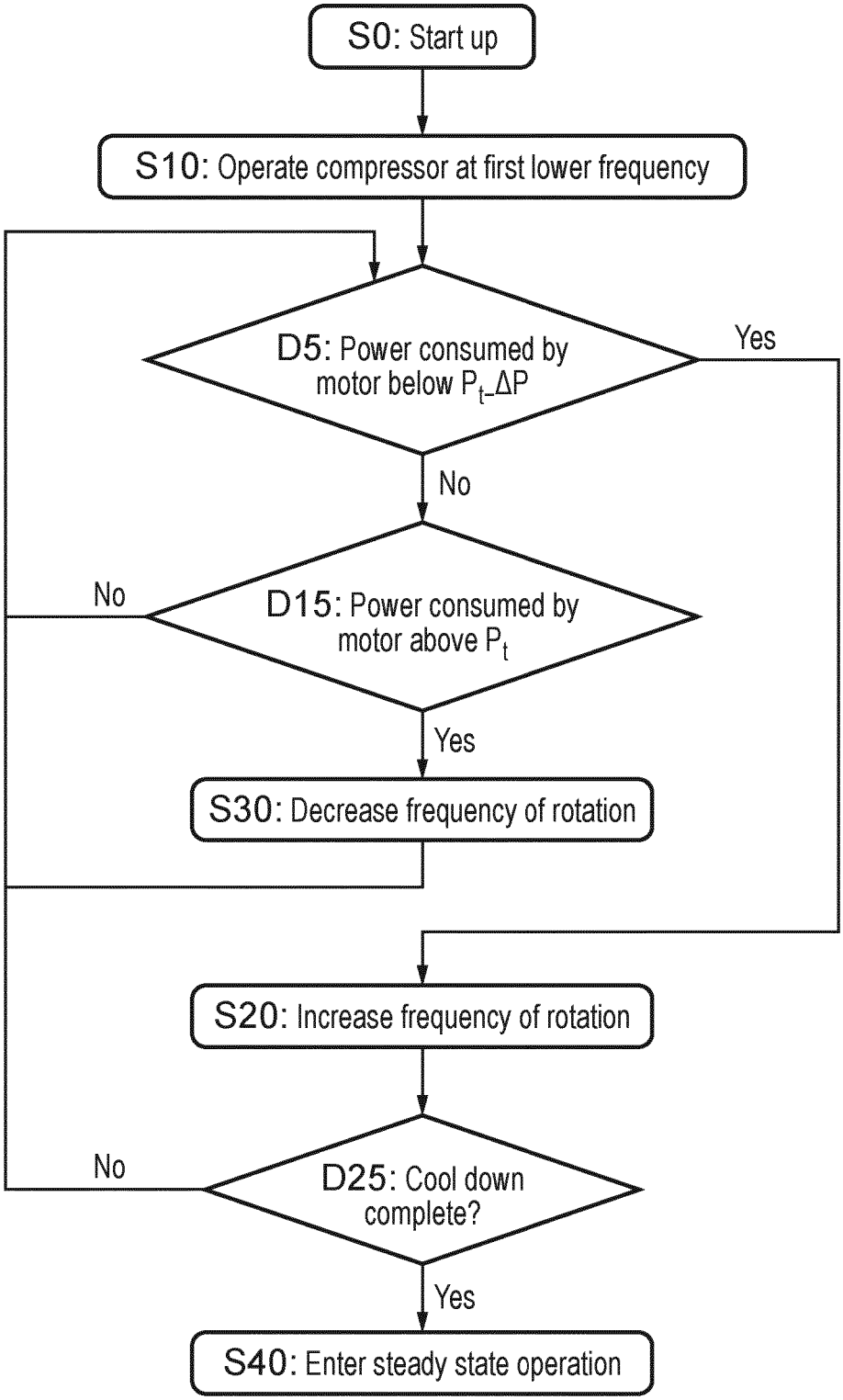
FIG. 4 schematically shows a flow diagram illustrating steps in a method according to an embodiment.

FIG. 4 schematically shows a flow diagram illustrating steps in a method according to an embodiment.

Start up occurs at step S0 which may be initial start up or start up following a break in the refrigeration cycle. The compressor motor is powered to operate at a first initial reduced frequency at step S10. The power consumed by the motor may be assessed continually, and this is shown at steps D5 and D15 and if it is below the threshold value Pt by more than a certain amount Δ P then the frequency of rotation of the motor is increased at step S20. If it is above the threshold Pt then the frequency of rotation is reduced at step S30. If it is within the range required then no change is made to the frequency of rotation.

Following an increase in the frequency of rotation at step S20 perhaps to or close to the maximum frequency of rotation, it is determined whether the cool down process is complete at step D25 and if it is then steady state operation is started.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A cryogenic refrigeration system comprising:

a refrigerator unit comprising an expansion unit;

a variable speed compressor configured to compress refrigerant, said variable speed compressor being configured to receive refrigerant from said refrigerator unit via a lower pressure line and to supply compressed refrigerant to said refrigerator unit via a higher pressure line; and control circuitry configured to control said variable speed compressor to maintain a power consumption of said variable speed compressor below a predetermined threshold value, by during cooldown controlling said compressor to initially operate at a reduced frequency and later increasing a frequency of operation of said variable speed compressor such that said variable speed compressor operates at a higher frequency.

2. The cryogenic refrigeration system according to claim 1, wherein said cryogenic refrigeration system is provided with additional refrigerant by at least one of:

increasing an initial filling pressure such that operation of said variable speed compressor at full speed during cool down of said refrigerator unit would result in the variable speed compressor consuming power above said predetermined threshold value; or by providing a buffer volume of refrigerant in fluid communication with said lower pressure line.

3. The cryogenic refrigeration system according to claim 1, wherein said control circuitry is further configured to control said variable speed compressor to maintain the pressure of said higher and lower pressure lines within predetermined limit values.

4. The cryogenic refrigeration system according to claim 1, wherein said control circuitry is configured to increase said frequency of operation of said variable speed compressor in response to a detected fall in power consumption of said variable speed compressor.

5. The cryogenic refrigeration system according to claim 1, wherein said initial reduced frequency of operation of said compressor is less than 70% of a maximum frequency of operation during a steady state of operation of said refrigeration unit.

6. The cryogenic refrigeration system according to claim 1, wherein said maximum frequency of operation during steady state operation is between 50 and 70 Hz and said initial frequency of operation during cooldown is between 30 and 50 Hz.

7. The cryogenic refrigeration system according to claim 1, wherein said refrigerant comprises helium.

8. The cryogenic refrigeration system according to claim 1, wherein said refrigeration unit is configured to cool to below 80K.

9. The cryogenic refrigeration system according to claim 2, wherein an initial pressure of said refrigerant is at least 5% higher than specified for said refrigeration unit where there is no power control of the variable speed compressor during cooldown.

10. The cryogenic refrigeration system according to claim 2, said refrigeration system further comprising said buffer volume of refrigerant, said buffer volume containing more than 20% of a total amount of refrigerant within said refrigeration system.

11. The cryogenic refrigeration system according to claim 1, wherein said control circuitry is further configured to control said variable speed compressor in a power save mode to maintain a power consumption of said variable speed compressor below a predetermined reduced threshold value.

12. A cryopump comprising a cryogenic refrigeration system according to claim 1.

13. A method of operating a cryogenic refrigeration system comprising a refrigerator unit comprising an expansion unit and a variable speed compressor configured to compress a refrigerant, such that a higher pressure refrigerant is supplied to said refrigerator unit and a lower pressure refrigerant is received from said refrigerator unit, said method comprising:

during an initial cooldown of said refrigeration unit operating said compressor at an initial lower frequency to maintain a power consumed by said variable speed compressor below a predetermined threshold value; and later increasing a frequency of operation of said compressor to a full speed of operation.

14. The method according to claim 13, said method comprising an initial step of providing said refrigeration system with an increased quantity of refrigerant by at least one of:

increasing a filling pressure of refrigerant within said system such that operation of said variable speed compressor during cool down at a maximum frequency of operation would exceed said predetermined threshold value for power consumption; or providing a buffer volume of additional refrigerant in fluid communication with said lower pressure line.

15. The cryogenic refrigeration system according to claim 5 wherein said initial reduced frequency of operation of said compressor is less than 60% of a maximum frequency of operation during a steady state of operation of said refrigeration unit.

16. The cryogenic refrigeration system according to claim 1, wherein said refrigeration unit is configured to cool to below 50K.

17. The cryogenic refrigeration system according to claim 1, wherein said refrigeration unit is configured to cool to below 10K.

18. The cryogenic refrigeration system according to claim 1, wherein said refrigeration unit is configured to cool to below 4K.

19. The cryogenic refrigeration system according to claim 2, wherein an initial pressure of said refrigerant is at least 10% higher than specified for said refrigeration unit where there is no power control of the variable speed compressor during cooldown.

20. The cryogenic refrigeration system according to claim 2, said refrigeration system further comprising said buffer volume of refrigerant, said buffer volume containing more than 50% of a total amount of refrigerant within said refrigeration system.

* * * * *